US010246204B2

(12) United States Patent
Rea

(10) Patent No.: US 10,246,204 B2
(45) Date of Patent: Apr. 2, 2019

(54) BEVERAGE CAPSULE MACHINE FOR MAKING SINGLE USE CAPSULES

(71) Applicant: IMA INDUSTRIES S.R.L., Ozzano Dell'Emilia (IT)

(72) Inventor: Dario Rea, Monterenzio (IT)

(73) Assignee: GIMA, S.P.A., Zola Predosa (IT)

( * ) Notice: Subject to any disclaimer, the term of this patent is extended or adjusted under 35 U.S.C. 154(b) by 540 days.

(21) Appl. No.: 14/372,012

(22) PCT Filed: Feb. 4, 2013

(86) PCT No.: PCT/IB2013/050942
§ 371 (c)(1),
(2) Date: Jul. 12, 2014

(87) PCT Pub. No.: WO2013/121319
PCT Pub. Date: Aug. 22, 2013

(65) Prior Publication Data

US 2014/0352254 A1 Dec. 4, 2014

(30) Foreign Application Priority Data

Feb. 15, 2012 (IT) ..... BO2012A0068

(51) Int. Cl.
*B65B 29/02* (2006.01)
*B65B 1/46* (2006.01)
(Continued)

(52) U.S. Cl.
CPC ..... *B65B 29/02* (2013.01); *B65B 1/46* (2013.01); *B65B 7/16* (2013.01); *B65B 7/164* (2013.01);
(Continued)

(58) Field of Classification Search
CPC .. B65B 29/02; B65B 1/46; B65B 7/16; B65B 7/164; B65B 43/52; B65B 55/24; B65B 65/003; B65B 51/002; B65B 85/8046
(Continued)

(56) References Cited

U.S. PATENT DOCUMENTS 2,807,352 A * 9/1957 Terry ..... A22C 21/06 198/803.14
3,339,701 A * 9/1967 Weichhand ..... B65G 17/12 198/449
(Continued)

FOREIGN PATENT DOCUMENTS

EP 1997748 A1 12/2008
JP S51-075767 U 6/1976
(Continued)

*Primary Examiner* — Alexander M Valvis
*Assistant Examiner* — Lucas E. A. Palmer
(74) *Attorney, Agent, or Firm* — Pearne & Gordon LLP

(57) ABSTRACT

A beverage capsule machine for making single use capsules (1) for infusion beverages such as coffee, milk, chocolate, tea or combinations of these ingredients, comprises: a transport element (8) for transporting rigid containers (2) and being dosed in a loop around movement means (9), with a vertical axis (Z9), for continuously moving the transport element (8); the element (8) being configured to define a plurality of pockets (10) for receiving the rigid containers (2) and arranged in succession, each having a respective vertical axis (Z10); a plurality of stations which are positioned along a path (P) followed by the transport element (8) and which are configured for operating continuously in phase with the transport element (8) and comprising at least: a feeding station (11) for feeding the rigid containers (2) into the respective pockets (10) of the transport element (8); a dosing station (12) for dosing the infusion product into the rigid container (2); a closing station (13) where the open aperture (4) of the rigid container (2) is closed with a length
(Continued)

of sheet (7); an outfeed station (14) for feeding out the capsules (1) made on the transport element (8).

13 Claims, 2 Drawing Sheets

(51) Int. Cl.

| | |
|---|---|
| ***B65B 43/52*** | (2006.01) |
| ***B65B 55/24*** | (2006.01) |
| ***B65B 7/16*** | (2006.01) |
| ***B65D 51/00*** | (2006.01) |
| ***B65D 85/804*** | (2006.01) |
| ***B65B 65/00*** | (2006.01) |

(52) U.S. Cl.
CPC ..... *B65B 29/022* (2017.08); *B65B 43/52* (2013.01); *B65B 55/24* (2013.01); *B65B 65/003* (2013.01); *B65D 51/002* (2013.01); *B65D 85/8046* (2013.01)

(58) Field of Classification Search
USPC ..... 53/502
See application file for complete search history.

(56) References Cited

U.S. PATENT DOCUMENTS 3,342,304 A * 9/1967 Greulich ..... B65B 35/44 134/82
3,965,656 A * 6/1976 Gerben ..... B65B 3/32 53/282
4,098,058 A * 7/1978 Carrigan ..... B65B 7/2807 141/238
5,197,259 A * 3/1993 Menayan ..... B65B 61/00 198/803.14
5,351,811 A * 10/1994 Tisma ..... B65G 17/42 198/793
5,649,412 A * 7/1997 Binacchi ..... B65B 9/023 426/77
6,170,650 B1 * 1/2001 Morikiyo ..... B62D 65/00 198/465.1
6,286,705 B1 * 9/2001 Mihalov ..... B29C 65/18 220/359.3
6,405,852 B1 * 6/2002 Christ ..... B65B 43/52 198/474.1
6,460,691 B1 * 10/2002 Gaensewig ..... B65B 43/52 198/793
6,662,531 B1 * 12/2003 Schwab ..... B29C 51/02 53/282
6,748,983 B2 * 6/2004 Bausch ..... B67C 3/242 141/1
8,066,115 B2 * 11/2011 Frattini ..... B21D 51/2692 198/803.14
8,455,773 B2 6/2013 Trebbi et al.
2003/0228964 A1 * 12/2003 Biba ..... B26D 1/045 493/81
2004/0020171 A1 * 2/2004 Biba ..... B26D 1/045 53/476
2004/0020172 A1 * 2/2004 Biba ..... B26D 1/045 53/478
2004/0035088 A1 * 2/2004 Loeffler ..... B26D 1/045 53/329.2
2004/0045257 A1 * 3/2004 Bakker ..... B65B 43/54 53/329.2
2005/0060963 A1 * 3/2005 Schubert ..... B65B 1/46 53/502
2007/0062164 A1 * 3/2007 Gamberini ..... B65G 47/525 53/502
2010/0200306 A1 8/2010 Trebbi
2012/0190521 A1 * 7/2012 Rivera ..... B31D 5/0082 493/58

FOREIGN PATENT DOCUMENTS

| | | | |
|---|---|---|---|
| JP | S52-030593 | A | 3/1977 |
| JP | S52-064661 | U | 5/1977 |
| JP | S62-019905 | U | 2/1987 |
| JP | S63-248608 | A | 10/1988 |
| JP | 2000-318713 | A | 11/2000 |
| JP | 2001-041808 | A | 2/2001 |
| JP | 2011-098738 | A | 5/2011 |
| WO | 2009040634 | A1 | 4/2009 |
| WO | 2010007633 | A1 | 1/2010 |
| WO | 2011039711 | A1 | 4/2011 |

* cited by examiner

BEVERAGE CAPSULE MACHINE FOR MAKING SINGLE USE CAPSULES

TECHNICAL FIELD

This invention has for an object a beverage capsule machine for making single use capsules for extract or infusion beverages such as coffee, tea, milk, chocolate or combinations of these ingredients.

BACKGROUND ART

The above mentioned capsules, used in machines for dispensing these beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of infusion beverage product contained in the outer container; and
- a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, which do not limit the invention, these capsules may comprise one or more rigid or flexible filtering elements.

For example, a first filter (if present) may be located on the bottom of the rigid container.

A second filter (if present) may be interposed between the seal and the product dose.

The capsule thus made up can be used in beverage dispensing machines comprising a housing for receiving the capsule.

At present, capsules of this kind are made using machines which operate in "step by step" fashion.

One known example of machines of this kind is described in patent publication WO2010/007633.

The machine described in that publication comprises a conveyor belt which is closed in a loop around two power-driven horizontal-axis pulleys in such a way as to form an upper, active section and a lower, non-operative return section.

The belt comprises a series of successive pockets which receive the rigid containers fed by a corresponding station located above the active section of the belt.

As it moves stepwise along a feed direction, the active section of the belt positions each pocket with a respective rigid container in it under a series of stations for making up the capsule.

Basically, the station which feeds the rigid container is followed by at least one station for dosing the product into the rigid container, a station for closing the aperture of the rigid container with a length of film (for example by heat-sealing) and, lastly, a station for feeding out the capsules thus made.

It should be noted, however, that along the rectilinear, active section of the belt, there may be further, auxiliary stations, for example to check capsule weight, form the length of film, remove rejects, and so on.

However, a single production line combined with step by step operation has proved to be low in productivity per unit time.

To overcome this problem, the belt was made wider in the direction transversal to the direction of belt motion so as to form two or more juxtaposed rows of pockets for receiving respective rigid containers.

This technical choice, however, meant augmenting the installed stations, like those mentioned above, placed side by side in a horizontal plane transversal to the direction of motion of the active section of the belt.

While this solution on the one hand partly improved the overall productivity of the machine per unit time, on the other it made the machine more cumbersome and decidedly more expensive and increased the risks of machine shutdowns owing to the large number of devices operating along the active section of the belt.

This structural choice does not therefore balance the overall costs with the results of operational productivity.

DISCLOSURE OF THE INVENTION

The aim of this invention is to provide a beverage capsule machine for making single use capsules for extract or infusion beverages such as coffee or tea and which overcomes the above mentioned disadvantages of the prior art.

More specifically, this invention has for an aim to provide a beverage capsule machine for making single use capsules for infusion beverages such as coffee or tea and which is capable of guaranteeing high productivity per unit time, with high operating speeds and a reduced number of operating stations, and guaranteeing also a high level of dependability.

A further aim of the invention is to provide a beverage capsule machine for making single use capsules for extract or infusion beverages such as coffee or tea and which has a compact structure, is reduced in size and makes good quality products.

These aims are fully achieved by the beverage capsule machine for making single use capsules for extract or infusion beverages according to the invention as characterized in the appended claims.

More specifically, the beverage capsule machine for making single use capsules for extract or infusion beverages, such as coffee or tea, comprises: a transport element for transporting the rigid containers and being closed in a loop around movement means, with a vertical axis, for continuously moving the transport element; the element is configured to define a plurality of pockets for receiving the rigid containers and arranged in succession, each having a respective vertical axis; a plurality of stations which are positioned along a path followed by the transport element and which are configured for operating continuously in phase with the transport element and comprising at least: a feeding station for feeding the rigid containers into the respective pockets of the transport element; a dosing station for dosing an extract or infusion product into the rigid container; a closing station where the open aperture of the rigid container is closed with a length of sheet (for example, of flexible material); an outfeed station which withdraws from the transport element each capsule formed.

A machine made in this way is capable of operating continuously with a transport element adapted to carry a single row of pockets containing respective rigid containers along a path where they meet the stations where the steps for making up the capsule are performed.

This architecture thus makes it possible for the machine as a whole to reach high production speeds in reduced spaces.

Preferably, the transport element for transporting the rigid containers is a chain comprising a plurality of links, hinged to one another in succession about corresponding vertical axes.

This solution allows high flexibility in making up the path to be followed by the transport element, with a wide range of possible geometrical shapes for the transport element to move in the proximity of the various different stations.

Preferably, each chain link comprises at least one vertical-axis pocket for receiving a respective rigid container positioned with the aperture facing upward.

It should be noted that the chain moves in a horizontal plane, is reduced in size and keeps the rigid containers in a stable and precise position as they move.

BRIEF DESCRIPTION OF DRAWINGS

These and other features of the invention will become more apparent from the following detailed description of a preferred, non-limiting embodiment of it, with reference to the accompanying drawings, in which.

DETAILED DESCRIPTION OF THE PREFERRED EMBODIMENTS OF THE INVENTION

With reference to the accompanying drawings, the machine according to this invention (denoted in its entirety by the numeral 100) is used to make single use capsules for extract or infusion beverages such as coffee, tea, milk, chocolate or combinations of these ingredients.

Figure 2:
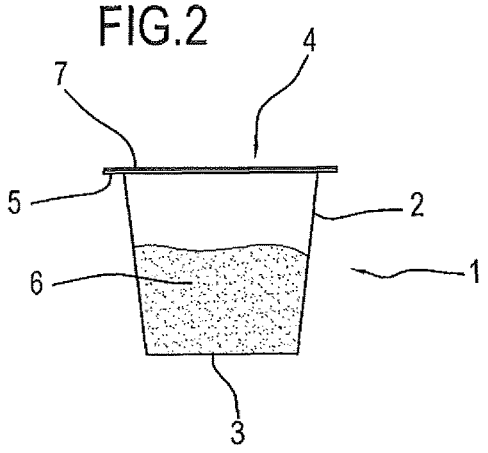
FIG. 2 is a schematic side view of a single use capsule, made with the machine of FIG. 1, for extract or infusion beverages such as coffee, tea, milk, chocolate or combinations of these ingredients.

More specifically—see FIG. 2—single use beverage capsules 1 comprise, in a minimum, non-limiting configuration: a rigid, cup-shaped container 2 (usually in the shape of a truncated cone) comprising a bottom 3 and an upper aperture 4 provided with a rim 5; a dose 6 of product for extraction or infusion contained within the rigid container 2 and a length of sheet 7 for sealing the upper aperture 4 of the rigid container 2.

If the length of sheet 7 is to be perforated when the beverage is made, the length of sheet 7 forms a hermetic seal for the rigid container 2.

It should be noted that the length of sheet 7 is obtained from a flexible web, that is to say, a web of material having flexibility properties.

It should also be noted that this type of capsule 1 may also comprise one or more filtering elements (not illustrated here since they do not form part of the invention).

More specifically, a first filter may be located on the bottom of the rigid container in order to improve the distribution of the infusion product.

The first filter may be a rigid filter.

Alternatively, the first filter may be a flexible filter.

The capsule 1 may also comprise a second filter positioned between the length of sheet 7 and the product dose: in this case, the second filter allows improved (uniform) distribution of the liquid on the product.

Figure 1:
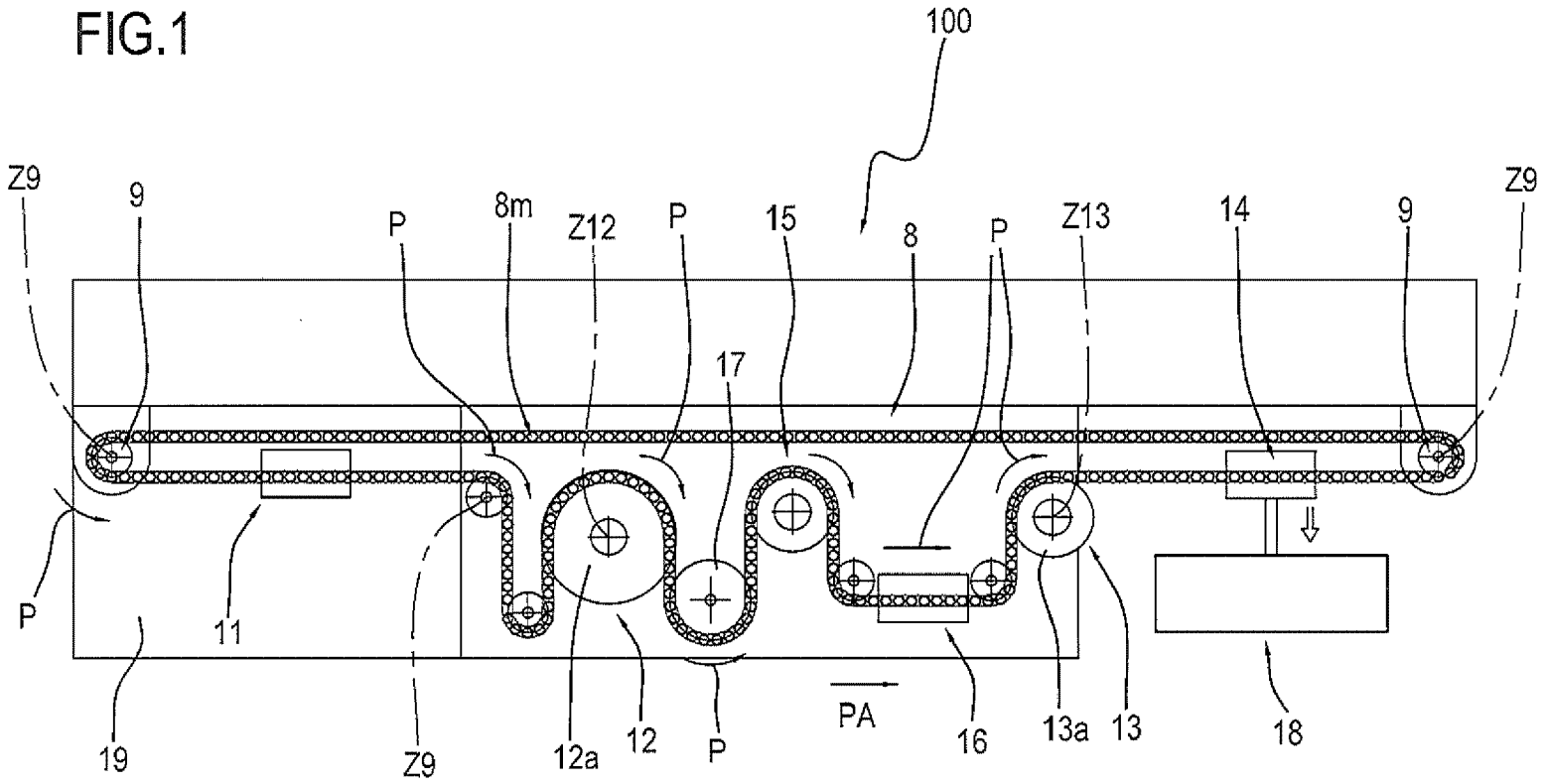
FIG. 1 is a schematic top plan view of a beverage capsule machine for making single use capsules for extract or infusion beverages such as coffee, tea, milk, chocolate or combinations of these ingredients.

According the invention (see FIG. 1), the machine 100 comprises a transport element 8 for transporting the rigid containers 2 and which is closed in a loop around movement means 9 which rotate continuously about vertical axes Z9 for continuously moving the transport element 8.

Figure 3:
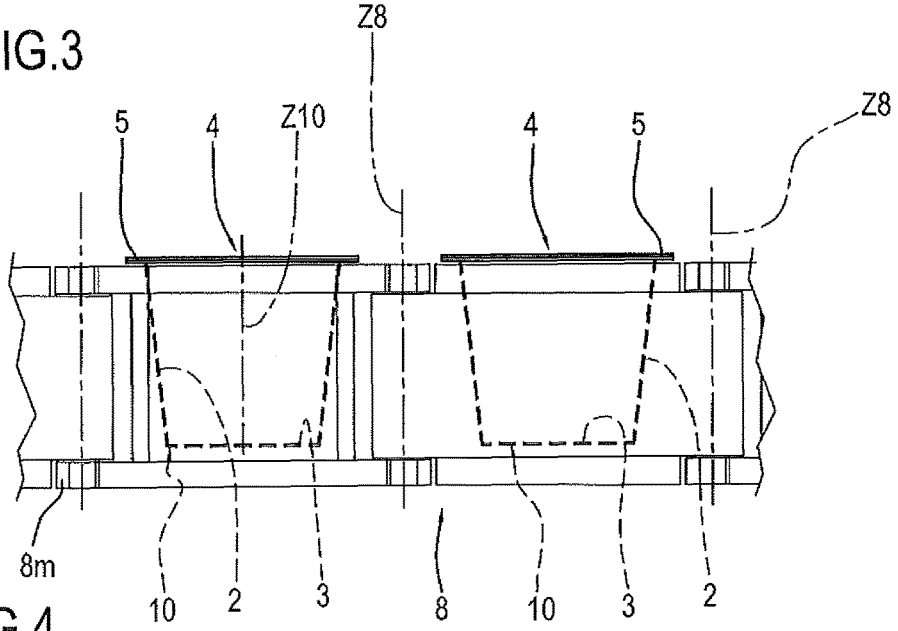
FIGS. 3 and 4 are a schematic side view and a schematic top plan view illustrating a part of a transport element for transporting a rigid container.
Figure 4:
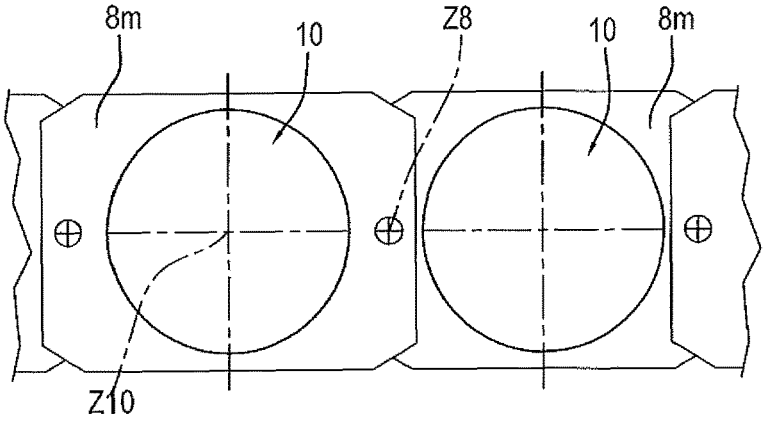

Also according to the invention, the transport element 8 is configured to define a plurality of pockets 10 for receiving the rigid containers 2 and arranged in succession, each having a respective vertical axis Z10 (see also FIGS. 3 and 4).

Again according to the invention, the machine 100 comprises a plurality of stations which are positioned along a path P followed by the transport element 8 and which are configured for operating continuously in phase with the transport element 8 and comprising at least four basic stations.

A feeding station 11 feeds the rigid containers 2 into respective pockets 10 of the transport element 8.

A dosing station 12 doses the extract or infusion product into the rigid container 2.

A closing station 13 closes the open aperture 4 of the rigid container 2 with the length of sheet 7.

An outfeed station 14 withdraws from the transport element 8 the capsule 1 formed.

Preferably, the transport element 8 for transporting the rigid containers 2 is a chain comprising a plurality of links 8*m*, hinged to one another in succession about corresponding vertical axes Z8 to form an endless loop.

It should be noted that at least one chain link 8*m* comprises at least one pocket 10, with a vertical axis Z9, for receiving a respective rigid container 2 positioned with the aperture 4 facing upward.

It should also be noted that the chain may comprise a plurality of links 8*m*, even not in uninterrupted succession, comprising pockets 10, each with a vertical axis Z9, for receiving respective rigid containers 2.

In other words, the chain 8 may include links which are not provided with pockets 10 and which are interposed between links 8*m* which are provided with pockets 10 (this embodiment not being illustrated).

Preferably, each link 8*m* of the chain 8 comprises at least one pocket 10, with a vertical axis Z9, for receiving a respective rigid container 2 positioned with the aperture 4 facing upward.

It should be noted that a chain made in this way forms a single row of rigid containers 2 moving continuously along a predetermined path P.

Preferably, the machine 100 comprises a cleaning station 17 for cleaning the rim 5 of the upper aperture 4 of the rigid container 2 and positioned downstream of the dosing station 12 with respect to a feed direction (indicated by the arrow PA) of the transport element 8.

Preferably, the cleaning station 17 is interposed between the dosing station 12 and a weighing station 15 (described below).

The cleaning station 17, too, is positioned along the path P and is configured to operate continuously and in phase with the transport element 8.

As mentioned above, the machine 100 comprises a weighing station 15 which weighs the rigid container 2 containing the product dose 6 and which is positioned along the path P of the transport element 8.

It should be noted that the weighing station 15 is configured to operate continuously and in phase with the transport element 8.

Preferably, the weighing station 15 is interposed between the dosing station 12 (or, more specifically, the cleaning station 17) and the closing station 13.

Preferably, the machine 100 comprises a cutting station 16 where the length of sheet 7 is cut and placed on the aperture 4 of the rigid container 2.

The cutting station 16, too, is positioned along the path P of the transport element 8, is configured to operate continuously and in phase with the transport element 8 and is located upstream of the closing station 13 with respect to a feed direction (again indicated by the arrow PA) of the transport element 8.

Preferably, the machine 100 comprises a stacking station 18 for stacking the capsules 1 made and which is positioned close to the outfeed station 14.

It should be noted that the stacking station 18 is configured to receive the capsules 1 along a direction transversal to the path P followed by the transport element 8 at the outfeed station 14.

The dosing station 12 and the closing station 13 preferably comprise a corresponding circular shaped distributor/actuator element 12*a*, 13*a* movable about a vertical axis Z12, Z13 in phase with the movement of the transport element 8; that way, the corresponding operations (releasing the product dose and closing—for example by heat sealing—with the length of film 7) along at least one stretch (circular arc) where the distributor/actuator elements 12*a* and 13*a* and the transport element 8 are movable in phase with each other along the same path.

Preferably, the path P of the transport element 8 is also defined by a plurality of power-driven transmission wheels 9, rotating about vertical axes Z9 and mounted (for example, keyed) to a supporting frame 19 extending in a horizontal plane; these wheels 9 define the above mentioned movement means.

It should be noted that the power-driven transmission wheels 9 are positioned along the frame 19 to define an operative, non-linear portion of the path P (completed by the passage along or around the above mentioned operating stations), and a non-operative, rectilinear, return portion of the path P.

Thanks to this structure and, more specifically, to the continuously moving looped chain which feeds the rigid containers, the machine is extremely compact and its production performance is higher than that of machines which operate with step-by-step motion.

The flexibility of the chain setup makes it possible to install the essential and auxiliary stations according to requirements at suitable positions along the path in such a way as to reduce the overall dimensions.

The flexibility of the chain setup also offers more opportunities to add alternative path stretches to allow making capsule variants (for example, including filtering elements).

The structure of the machine is therefore extremely flexible and allows high productivity levels to be attained, while maintaining good end product quality standards.

The invention claimed is:

1. A beverage capsule machine for making single use capsules (1) for extract or infusion beverages, such as coffee or tea, comprising: a rigid, cup-shaped container (2) comprising a bottom (3) and an upper aperture (4) provided with a rim (5); a dose (6) of product for extraction or infusion contained within the rigid container (2) and a length of flexible sheet (7) for sealing the upper aperture (4) of the rigid container (2), characterized in that the beverage capsule machine comprises:

a transport element (8) for transporting the rigid containers (2) and being closed in a loop around movement means (9) which rotate continuously about vertical axes (Z9) for continuously moving the transport element (8); the loop defining a loop pathway which extends in a horizontal plane; the transport element (8) being configured to define a plurality of pockets (10) for receiving the rigid containers (2) and which are positioned one after the other, in succession, each pocket (10) having a respective pocket vertical axis (Z10) which extends in a direction perpendicular to the plane defined by the loop pathway;

a plurality of operating stations which are positioned along a path (P) followed by the transport element (8) and which are configured for operating continuously in phase with the transport element (8) and comprising:

a feeding station (11) for feeding the rigid containers (2) into respective pockets (10) of the transport element (8);

a dosing station (12) for dosing the product into the rigid container (2);

a closing station (13) where the upper aperture (4) of the rigid container (2) is closed with the length of sheet (7);

an outfeed station (14) which withdraws from the transport element (8) each capsule (1) formed;

wherein the transport element (8) is a chain having a longitudinal axis and comprising a plurality of links (8*m*) hinged to one another in succession about corresponding hinge vertical axes (Z8), the longitudinal axis of the chain intersecting each pocket vertical axis (Z10); each pocket (10) extending through an upper portion of a respective link (8*m*) so that, when a respective rigid container (2) is received in a respective pocket (10), the respective rigid container (2) extends through an opening in an upper portion of the respective link (8*m*);

wherein the transport element (8) defines a non-linear portion of the path (P) at least when the rigid containers (2) are dosed with the product by the dosing station (12) or at least when the upper aperture (4) of the rigid containers (2) are closed with the length of flexible sheet (7) for hermetic sealing the upper aperture (4) of the rigid container (2) by the closing station (13);

wherein at least the dosing station (12) and the closing station (13) comprise a corresponding circular shaped distributing/actuating element (12*a*, 13*a*) movable about a vertical axis (Z12, Z13) and in phase with the transport element (8) so as to carry out corresponding dosing and closing operations along at least one circular arc where the distributing/actuating element (12*a*, 13*a*) and the transport element (8) are movable in phase along the same path; and wherein each of the dosing station (12) and the closing station (13) define an arcuate pathway for the transport element (8) to follow.

2. The machine according to claim 1, wherein the longitudinal axis of the chain intersects each hinge vertical axis (Z8).

3. The machine according to claim 2, wherein at least one of the chain links (8*m*) comprises at least one pocket (10)

with vertical axis (Z10) for a corresponding rigid container (2) positioned with the upper aperture (4) facing upward.

4. The machine according to claim 1, comprising a weighing station (15) for weighing the rigid container (2) containing a dose (6) of product, positioned along the path (P) of the transport element (8); the weighing station (15) being configured to operate continuously and in phase with the transport element (8), and being interposed between the dosing station (12) and the closing station (13).

5. The machine according to claim 1, comprising a cutting station (16) where the length of flexible sheet (7) is cut and placed on the upper aperture (4) of the rigid container (2); the cutting station (16) being positioned along the path (P) of the transport element (8), being configured to operate continuously and in phase with the transport element (8) and being upstream of the closing station (13) with respect to a feed direction (PA) of the transport element (8).

6. The machine according to claim 1, comprising a cleaning station (17) for cleaning the rim (5) of the upper aperture (4) of the rigid container (2) and positioned downstream of the dosing station (12) with respect to a feed direction (PA) of the transport element (8); the cleaning station (17) being positioned along the path (P) and being configured to operate continuously and in phase with the transport element (8).

7. The machine according to claim 1, comprising a stacking station (18) for stacking the capsules (1) made, which is positioned close to the outfeed station (14) and which is configured to receive the same capsules (1) along a direction transversal to the path (P) of the transport element (8) at the outfeed station (14).

8. The machine according to claim 1, wherein the path (P) of the transport element (8) is also defined by a plurality of power-driven transmission wheels (9), rotating about vertical axes (Z9) and mounted on a supporting frame (19) extending in a horizontal plane; the power-driven transmission wheels (9) defining the movement means.

9. The machine according to claim 8, wherein the power-driven transmission wheels (9) define an operative, non-rectilinear portion of the path (P), and a non-operative, rectilinear, return portion of the path (P).

10. The machine according to claim 1, wherein the non-linear portion is a curved portion.

11. The machine according to claim 1, wherein each link (8*m*) of the chain is rotatable only about each of a pair of vertical axes (Z8).

12. The machine according to claim 1, wherein the chain has a width, the width of the chain being sufficient to accommodate only one single file row of pockets (10).

13. The machine according to claim 1, wherein each pocket (10) is configured so that when a respective rigid container (2) is received in a respective pocket (10), the bottom (3) of the respective rigid container (2) is located between an upper portion and a lower portion of the respective link (8*m*).

* * * * *